US006836615B1

(12) United States Patent
Bradenbaugh

(10) Patent No.: US 6,836,615 B1
(45) Date of Patent: Dec. 28, 2004

(54) HEAT DISSIPATION DEVICE AND WATER HEATER INCLUDING THE SAME

(76) Inventor: Ken A. Bradenbaugh, 10100 Pinecrest Rd., Concord, OH (US) 44077

( * ) Notice: Subject to any disclaimer, the term of this patent is extended or adjusted under 35 U.S.C. 154(b) by 0 days.

(21) Appl. No.: 10/619,768

(22) Filed: Jul. 15, 2003

(51) Int. Cl.[7] ..... F24H 1/18
(52) U.S. Cl. ..... 392/449; 392/459
(58) Field of Search ..... 392/441, 449, 392/451, 455, 458, 459, 497, 507

(56) References Cited

U.S. PATENT DOCUMENTS

| | | | | |
|---|---|---|---|---|
| 3,163,207 A | | 12/1964 | Schultz | |
| 3,462,553 A | | 8/1969 | Spranger | |
| 3,911,693 A | | 10/1975 | Seigler et al. | |
| 4,007,378 A | | 2/1977 | Lazzara | |
| 4,978,833 A | | 12/1990 | Knepler | |
| 5,486,972 A | | 1/1996 | Taylor | |
| 5,787,971 A | | 8/1998 | Dodson | |
| 5,831,250 A | * | 11/1998 | Bradenbaugh | 219/497 |
| 5,933,324 A | | 8/1999 | Barrett | |
| 6,151,448 A | * | 11/2000 | Reusche et al. | 392/501 |
| 6,390,181 B1 | | 5/2002 | Hall et al. | |
| 6,516,141 B1 | * | 2/2003 | DeSantis et al. | 392/451 |

* cited by examiner

*Primary Examiner*—Thor Campbell
(74) *Attorney, Agent, or Firm*—Michael Best & Friedrich LLP

(57) ABSTRACT

A heat dissipation device for mounting a heat-generating component to a heat sink, such as a water heater. The heat-dissipating device includes a base having a first surface configured to follow the shape of the heat sink and a second surface. At least one heat-dissipating element is coupled to the base. The heat-generating component includes an electrical switching device, such as a triac, and is coupled to the second surface of the base.

47 Claims, 3 Drawing Sheets

HEAT DISSIPATION DEVICE AND WATER HEATER INCLUDING THE SAME

FIELD OF THE INVENTION

The invention relates generally to a method and apparatus for mounting and cooling electrical devices that generate heat. More specifically, the invention relates to the mounting and cooling of a switching device, such as a triac.

BACKGROUND

A storage-type water heater typically comprises a permanently enclosed water tank, a cylindrical shell coaxial with and radially spaced apart from the water tank to form an annular space between the outer wall of the water tank and the inner wall of the shell, and insulating material in at least a portion of the annular space for providing thermal insulation to the water tank. The water tank has various appurtenances such as inlet, outlet, and drain fittings. Additionally, the water heater is provided with a water heating and temperature control system. In electric water heaters, the water heating and temperature control system includes an electrical resistance heating element.

Modern electric water heating and temperature control systems typically further include an electronic thermostat. The electronic thermostat closes a switch to allow electrical power through the electrical resistance heating element when water in the tank is sensed to be below a selected set-point temperature, and opens the switch to stop electrical power from passing through the electrical resistance heating element when the water in the tank is at or above the set point temperature. The switch is an electrical component that generates heat during use. The generated heat can interfere with the reliability of and the function of the switch. It would be beneficial to provide a way to dissipate the generated heat to ensure the proper operation of both the switch, and any other electrical components surrounding the switch.

SUMMARY

Accordingly, and in one embodiment, the invention provides a water heater connectable to a power source. The water heater includes a vessel having an exterior surface, and a thermally conductive mounting device coupled to the exterior surface. The mounting device includes a base having a first surface configured to substantially follow the shape of an exterior surface of the vessel, a second surface, and a heat dissipating element coupled to the base. The water heater also includes a controller configured to selectively generate a signal based on a temperature of water in the vessel. A switch is connectable to the power source, connected to the controller, and coupled to the second surface of the base. The switch conducts power from the power source in response to the signal. The water heater also includes a heating element connected to the switch to receive the power.

In another embodiment, the invention provides for a heat dissipation device adapted to receive a heat-generating component and to couple to an exterior surface of a heat sink. The heat dissipation device includes a base having a first surface configured to substantially follow the shape of the exterior surface of the heat sink, and a second surface. The heat-generating component couples to the second surface of the base. The heat dissipation device includes a thermally conductive, electrically dielectric material to conduct heat from the heat-generating component to the heat sink.

In yet another embodiment, the invention provides for a water heater having a water tank with an arcuate exterior surface, and a thermally conductive mounting device coupled to the exterior surface of the water tank. The mounting device includes a base having an arcuate first surface and a second surface. A heat-dissipating element is coupled to the base. The water heater further comprises a switch coupled to the second surface of the base. In one construction, the water heater further comprises a second switch coupled to the second surface, and the second surface includes a channel between the first and second switches.

Other features and advantages of the invention will become apparent to those skilled in the art upon review of the following detailed description, claims and drawings.

DETAILED DESCRIPTION

Before any aspects of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. The terms "connected," "coupled," and "mounted" and variations thereof herein are used broadly and, unless otherwise stated, encompass both direct and indirect connections, couplings, and mountings. In addition, the terms connected and coupled and variations thereof herein are not restricted to physical and mechanical connections or couplings.

Figure 1:
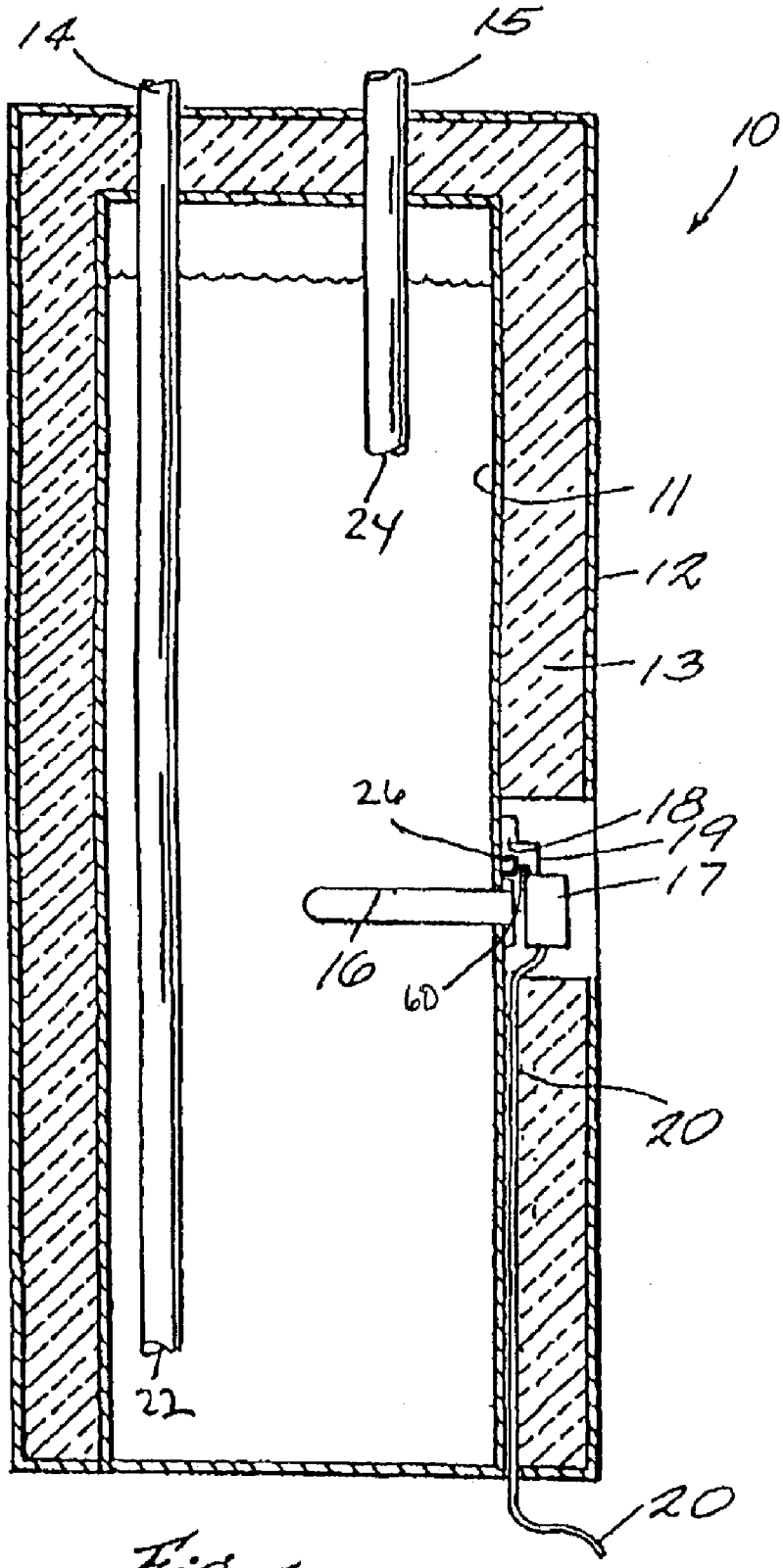
FIG. 1 is a sectional view of a water heater.

FIG. 1 shows a sectional view of an electric water heater 10 comprising a vessel. The vessel is defined as one of an enclosed water tank 11 or a shell 12 surrounding the water tank 11. Foam insulation 13 fills the annular space between the water tank 11 and the shell 12. A water inlet line or dip tube 14 and a water outlet line 15 enter the top of the water tank 11. The water inlet line 14 has an inlet opening 22 for adding cold water near the bottom of the water tank 11. The water outlet line 15 has an outlet opening 24 for withdrawing hot water from near the top of the water tank 11.

A heating element 16 extends through the wall of the water tank 11. In the illustrated embodiment, the heating element 16 is an electric resistance heating element. However, other types of heating elements can be used. The temperature control circuitry controls the heating of the water. The temperature control circuitry includes a controller (in control box 17), a temperature sensor assembly 18, and the heating element 16. In one construction, the temperature control circuitry includes a burst control circuit for providing power to the resistance heating element in bursts.

The details of a burst control circuit are described in U.S. patent application Ser. No. 09/752,477, entitled PROPORTIONAL BAND TEMPERATURE CONTROL FOR ONE OR MORE HEATING ELEMENTS, filed Jan. 2, 2001, the entire disclosure of which is incorporated herein by reference. However, the temperature control circuitry can use other circuitries and other methodologies for heating the water.

In some constructions, the temperature control circuitry in control box 17 includes a programmable real time clock. Peak or off-peak energy demand periods or vacation operation cycles are programmed into the control cycle for the heating element. Additionally, a pressure sensor, temperature sensor, mineral deposit sensor and/or sensor for detecting the presence of water could be added. In one method of operation of the water heater 10, the control circuit is programmed to disconnect power from the heating element when predetermined conditions or limits are detected.

Referring again to FIG. 1, the temperature sensor assembly 18 is coupled to the outer wall of the water tank 11 to sense the temperature of water in the tank 11. The temperature sensor assembly can include one or more thermistors for sensing the temperature of the water in the tank 11 placed throughout the tank to measure water temperature at a plurality of locations. Where multiple thermistors are used, the output of the thermistors can be averaged. However, the temperature sensor assembly can use other types of temperature sensors and can be simply a single sensor.

The temperature sensor assembly 18 is connected to the controller, for example, by an electrical wire 19. The controller is a known control system in the art that is in communication with the heating element 16 and the temperature sensor assembly 18 and generates a signal activating the heating element in response to the temperature sensed by the sensor assembly 18. The controller can include an integrated circuit, a programmable device, discrete circuit elements, a processor and memory, and similar components.

The temperature control circuitry also includes a switching device (or simply a switch), which may be part of the controller. The switching device is coupled to the outer wall of the vessel, i.e., the tank 11 or the shell 12, to selectively supply power to the heating element. The details of the switching device will be discussed in detail below.

Figure 2:
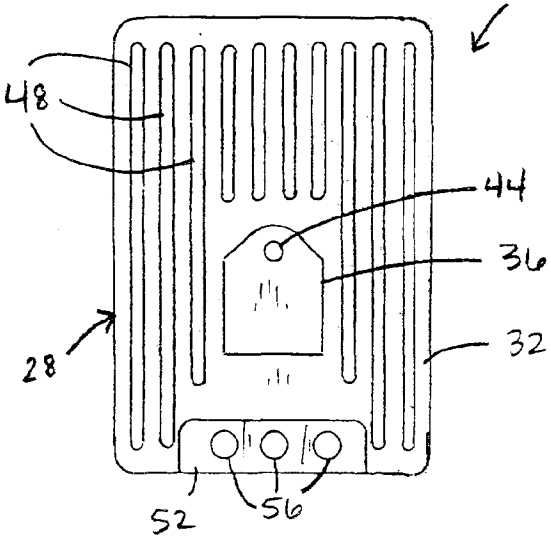
FIG. 2 is a front view of a mounting device capable of being used in the water heater of FIG. 1.

FIG. 2 illustrates a heat dissipation mounting device 26 having a base 28. The base 28 includes a first surface 30 (see FIG. 5) and a second surface 32. The configuration of the first surface 30 is described in more detail below with respect to FIG. 5. The mounting device 26 is comprised of a thermally conductive, electrically dielectric material, such as styrene, polycarbonate, ABS plastic, or any other appropriate thermally conductive material. In the illustrated construction, the mounting device 26 is coupled to the exterior surface of the tank 11 and provides a thermal path to transfer heat energy from the mounting device 26 to the tank 11. It should be understood that while the mounting device 26 is illustrated as being coupled to the tank in a water heater, the mounting device can also be used with motors, dryers, conveyors, refrigeration units, or any other environment where it is necessary or desired to provide a heat dissipating device that is electrically isolated.

The second surface 32 of the mounting device includes a mounting platform 36 for receiving a heat-generating component. The platform 36 can be flush with, or project upwardly from, the second surface 32. The platform 36, which can be considered a surface, is preferably similar in shape to the heat-generating component and in some constructions can be the same shape as the heat-generating component. In other constructions, the second surface 32 can include a flat receiving portion 38 such that the heat-generating component can be coupled directly to the second surface 32. The flat receiving portion 38, which can also be considered a surface, may be integral with or recessed into the second surface 32 (see FIG. 5, in phantom).

Figure 5:
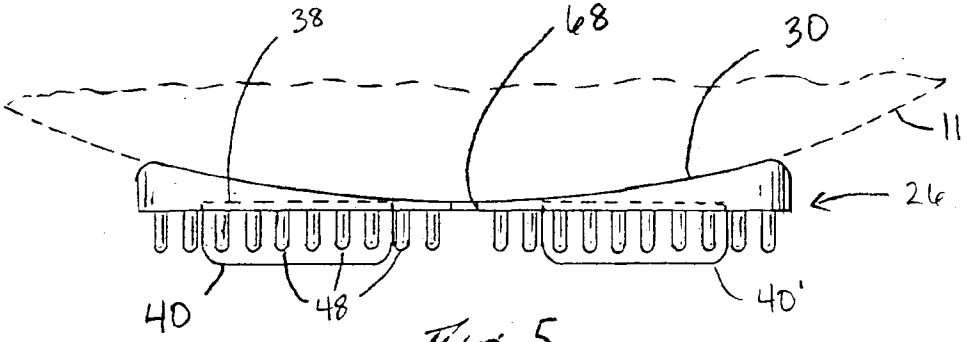
FIG. 5 is a top view of a mounting device capable of being used in the water heater of FIG. 3.

In the illustrated construction, the heat-generating component is a switching device, such as a thyristor or a triac 40. FIG. 5 illustrates the mounting device 26 including a triac 40. An exemplary triac 40 is a BTA-26, available from ST Microelectronics. The triac 40 controls electric power to the heating element in response to a control signal from the controller. The triac 40 mounts to the base 28 via a coupling member, such as a screw or a bolt, secured through the triac 40 and through an aperture 44 in the platform 36, thereby mechanically coupling the triac 40 to the mounting device 26 (see FIG. 2). Other methods of fastening the triac 40 to the base 28 are possible.

The base 28 also includes at least one heat-dissipating element, such as a heat-dissipating fin 48. In the illustrated embodiments, a plurality of fins 48 are coupled to the base 28. It is understood that the fins can also be integrally formed with the base, such as by molding. The base 28 also includes a terminal block 52. The terminal block 52 includes electrical terminal connections 56 molded into the block 52. Conductors can also be molded into the base to couple the triac 40 to the connections 56 to provide an electrical pathway between the triac 40 and an electrical wire 60. The electrical wire 60 (see FIG. 1) electrically couples the triac 40 to the controller in the control box 17. The electrically dielectric material of the base 28 electrically isolates the terminal connections 56, and thus the triac 40, such that the triac 40 can be mounted on an otherwise electrically conductive surface (i.e., the metal wall of the vessel).

Figure 3:
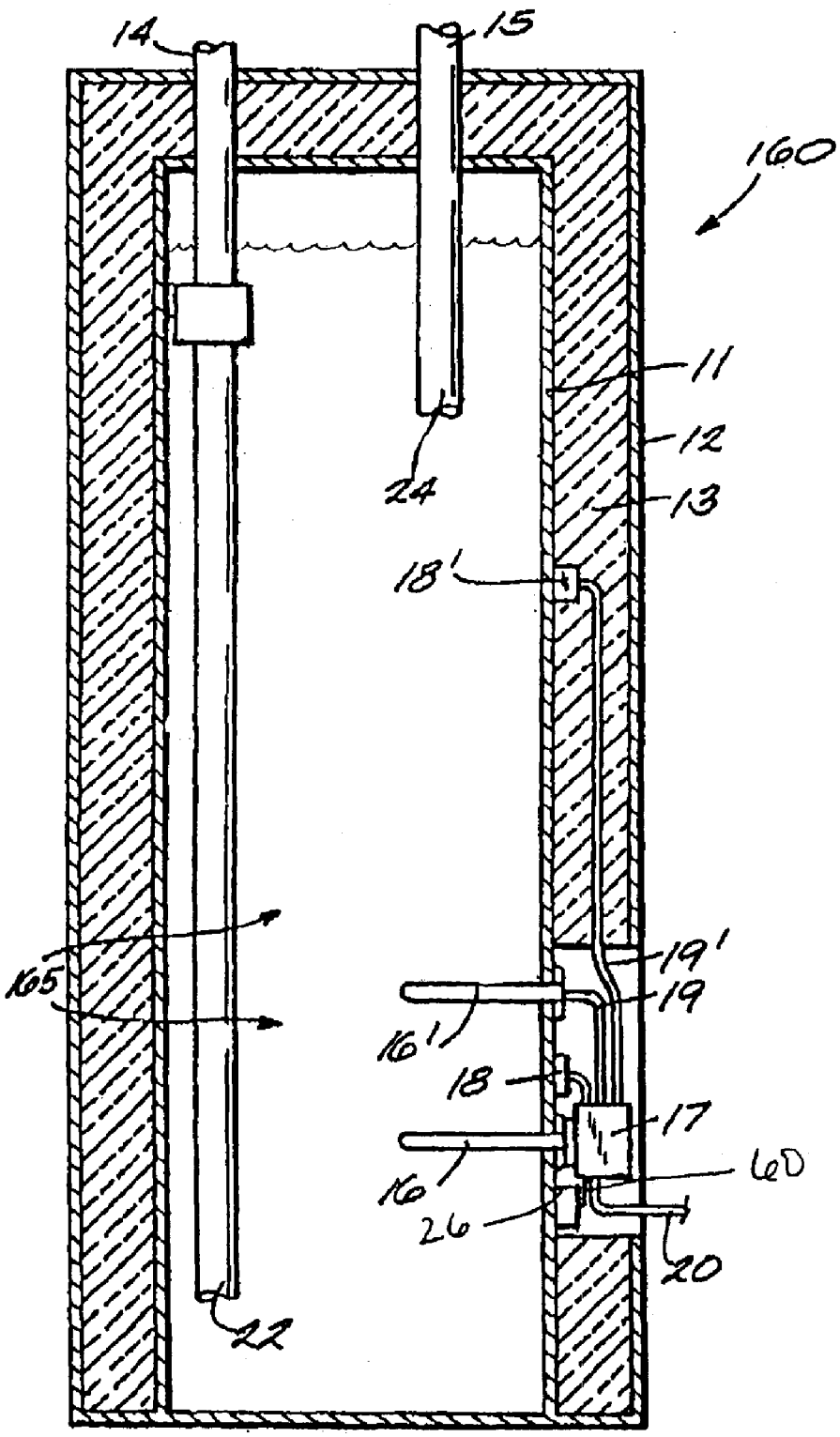
FIG. 3 is a sectional view of an alternative water heater.

Another water heater 160 embodying the invention is shown in FIG. 3. The water heater 160 shares many common elements with the water heater 10, and common elements are designated with the same reference numerals as in FIG. 1.

As shown in FIG. 3, the water heater 160 includes two heating elements 16, 16' extending into the tank 11. The heating elements 16, 16' are controlled by the control circuitry stored in control box 17, which receives input from temperature sensors 18 and 18'. Alternatively, the water heater 160 may include more than one control box, may include more than two heating elements, and may include more than two temperature sensors. The heating elements 16, 16' are activated sequentially or at some predetermined frequency or fashion so that heat is transferred to the tank 11 in a balanced or uniform manner.

Figure 4:
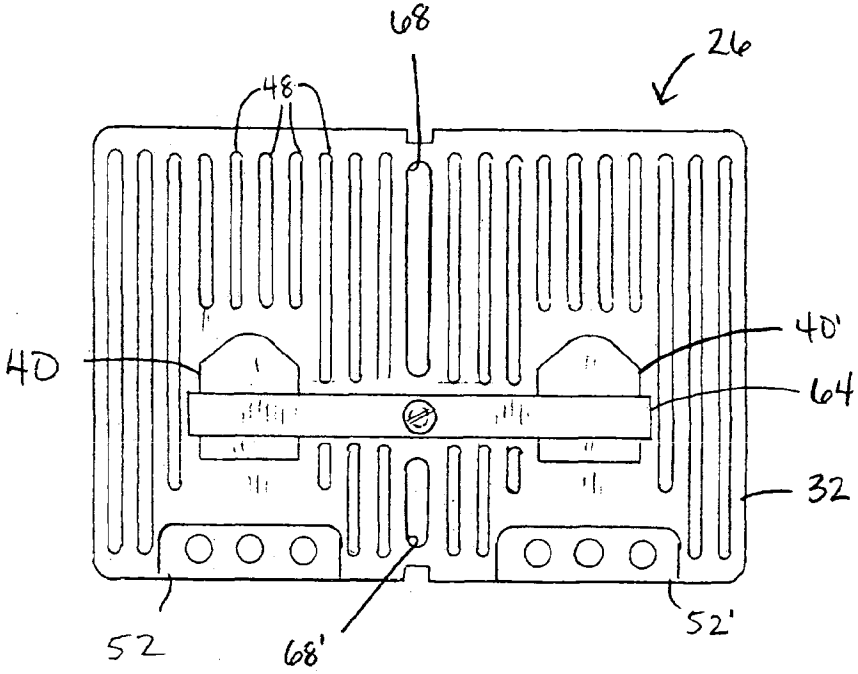
FIG. 4 is a front view of an alternative mounting device capable of being used in the water heater of FIG. 3.

When two heating elements are utilized in a water heater, it may be necessary for the controller to include two triacs 40, 40'. With reference to FIGS. 4 and 5, the second surface 32 of the mounting device 26 is adapted to receive two heat-generating components. The triacs 40, 40' are coupled to the mounting device 26 by a coupling bar 64 that is mechanically attached to the second surface 32 by a screw or a bolt. The coupling bar 64 secures the triacs 40, 40' to the mounting device 26.

As further illustrated in FIG. 4, the base 28 also includes central channels 68, 68' that extend between the mounting platforms 36, 36' on the second surface 32 of the base 28. The central channels 68, 68' include voids and provide a barrier to thermal conduction from one side of the base 28 to the other. In instances where only one triac 40 is operating (and thus heat is only generated on one side of the mounting device 26), it is desirable to prevent that dissipated heat from traveling to the dormant triac 40'. By providing the channels 68, 68', the majority of the heat generated by the single working triac 40 will be prevented from traveling to the dormant triac 40', as the heat cannot cross the channels 68, 68'. Instead, the heat will be dissipated by the fins 48 and the thermal pathway to the tank 11. The number of channels and their location can vary.

With reference to FIG. 5, the first surface 30 of the mounting device 26 is configured to follow the shape of the device to which it will be mounted. In the illustrated construction, the first surface 30 is arcuate to follow the shape of the surface of the generally cylindrical tank 11. However, it is understood that in other constructions, the first surface 30 can be configured to follow any surface shape, be it flat, arcuate, or otherwise. The mounting device 26 is coupled to the tank 11 along the first surface 30 using a thermally conductive epoxy. A suitable epoxy is 705 TC, manufactured by MASTERBOND, INC. One of either the first surface 30 of the mounting device 26 or the surface of the tank 11 can be roughened to enhance the strength of the bond between the mounting device 26 and the tank 11.

As a signal runs through the triacs 40, 40', the triacs 40, 40' consume energy and generate heat. If this heat is not dissipated, it can cause run away conditions in the triacs 40, 40', causing the triacs 40, 40' to stay on continuously, overheat, and/or eventually burn out. The mounting device 26 dissipates this heat in two ways. First, heat is dissipated by the fins 48 coupled to the second surface 32 of the mounting device 26. Air passing over the surfaces of the fins 48 will dissipate some of the generated heat into the ambient atmosphere. Second, since the mounting device 26 is in thermal communication with the tank 11, most of the generated heat can be conducted through the mounting device 26 into the tank 11 to be reused by the water heater 10. In some constructions, greater than fifty percent of the generated heat could be captured and used by the water heater 10. This increases the heating efficiency of the water heater 10.

Various other features and advantages of the invention are set forth in the following claims.

What is claimed is:

1. A water heater connectable to a power source, the water heater comprising:

a vessel having an exterior surface;

a thermally conductive mounting device coupled to the exterior surface, the mounting device comprising a base having a first surface configured to follow the shape of the exterior surface of the vessel, and a second surface, and a heat-dissipating element coupled to the base;

a controller configured to selectively generate a signal based on a temperature of water in the vessel;

a switch connectable to the power source, connected to the controller, and coupled to the second surface of the base, the switch configured to conduct power from the power source in response to the signal; and a heating element connected to the switch to receive the power.

2. The water heater of claim 1, wherein the exterior surface of the vessel is arcuate, and wherein the first surface of the base is arcuate to follow the shape of the vessel.

3. The water heater of claim 1, wherein the vessel is substantially cylindrical.

4. The water heater of claim 1, wherein the heat-dissipating element is coupled to the second surface.

5. The water heater of claim 1, wherein the heat-dissipating element is integrally formed with the base.

6. The water heater of claim 5, wherein the base and the heat-dissipating element form a heat-dissipating surface.

7. The water heater of claim 6, wherein the heat-dissipating surface includes the second surface.

8. The water heater of claim 1, wherein the thermally conductive mounting device further includes a mounting platform coupled to the base, and wherein the second surface includes the mounting platform.

9. The water heater of claim 1, wherein the switch includes an electronic switch.

10. The water heater of claim 9, wherein the electronic switch includes a triac.

11. The water heater of claim 1, wherein the mounting device comprises a thermally conductive, electrically dielectric material such that heat conducted by the mounting device can pass to the exterior surface of the vessel.

12. The water heater of claim 11, wherein the mounting device further comprises terminal connections molded into a terminal block, the switch being electrically coupled to the terminal connections, and wherein the thermally conductive, electrically dielectric material electrically isolates the terminal connections from the vessel.

13. The water heater of claim 1, wherein the mounting device is coupled to the vessel using a thermally conductive epoxy.

14. The water heater of claim 1, wherein the second surface of the mounting device includes a flat portion to accept the direct mounting of the switch.

15. The water heater of claim 1, wherein the mounting device includes a plurality of heat-dissipating elements.

16. The water heater of claim 15, wherein the plurality of heat-dissipating elements are a plurality of heat-dissipating fins.

17. The water heater of claim 1, wherein the controller includes the switch.

18. The water heater of claim 1, wherein the mounting device further comprises a second mounting platform, and wherein the controller is configured to selectively generate a second signal based on the temperature of water, and wherein the water heater further comprises a second switch connectable to the power source, connected to the controller, and coupled to the second mounting platform, the second switch configured to conduct power from the power source in response to the second signal, and wherein the water heater further comprises a second heating element connected to the second switch to receive the power.

19. The water heater of claim 1, wherein the controller is configured to selectively generate a second signal based on the temperature of water, and wherein the water heater further comprises a second switch connectable to the power source, connected to the controller, and coupled to the second surface, the second switch configured to conduct power from the power source in response to the second signal, and wherein the water heater further comprises a second heating element connected to the second switch to receive the power.

20. The water heater of claim 1, wherein the water heater further comprises a second switch connectable to the power source, connected to the controller, and coupled to the second surface, and wherein the base includes a channel between the first and second switches.

21. A heat dissipation device adapted to receive a heat-generating component and to couple to an exterior surface of a heat sink, the heat dissipation device comprising:

a base having a first surface configured to substantially follow the shape of the exterior surface of the heat sink, and a second surface configured to receive the heat-generating component; and at least one heat-dissipating element integrally formed with the second surface of the base;

wherein the heat dissipation device comprises a thermally conductive, electrically dielectric material to conduct heat from the heat-generating component to the heat sink.

22. The heat dissipation device of claim 21, wherein the exterior surface of the heat sink is arcuate, and wherein the first surface of the base is arcuate to follow the shape of the vessel providing increased contact between the base and the vessel.

23. The heat dissipation device of claim 21, wherein the heat-generating component is a switch.

24. The heat dissipation device of claim 23, wherein the switch includes an electronic switch, such as a triac.

25. The heat dissipation device of claim 21, wherein the heat sink comprises a vessel in a water heater.

26. The heat dissipation device of claim 21, wherein the heat dissipation device is coupled to the surface of the heat sink by a thermally conductive epoxy.

27. The heat dissipation device of claim 21, wherein the heat-dissipating element is coupled to the second surface.

28. The heat dissipation device of claim 21, wherein the heat dissipation device includes a plurality of heat-dissipating elements.

29. The heat dissipation device of claim 28, wherein the heat-generating component is coupled within the plurality of heat-dissipating elements such that the heat-dissipating elements are symmetrical about the heat-generating component.

30. The heat dissipation device of claim 21, wherein the second surface includes a flat portion to accept direct mounting of the heat-generating component.

31. The heat dissipation device of claim 21, wherein the heat dissipation device includes a mounting platform coupled to the base, and wherein the second surface includes the mounting platform.

32. The heat dissipation device of claim 21, wherein the second surface is adapted to receive at least two heat-generating components, and wherein the second surface includes a channel between the first and second heat-generating components.

33. The heat dissipation device of claim 21, wherein the heat dissipation device includes a second mounting platform to receive a second heat-generating component, and wherein the base includes a channel between the first and second heat-generating components.

34. The heat dissipation device of claim 21, wherein the heat dissipation device further comprises terminal connections molded into a terminal block, the heat-generating component being electrically coupled to the terminal connections, and wherein the thermally conductive, electrically dielectric material electrically isolates the terminal connections from the heat sink.

35. A water heater connectable to a power source, the water heater comprising:

a water tank having an arcuate exterior surface;

a thermally conductive mounting device coupled to the exterior surface of the water tank, the mounting device comprising a base having an arcuate first surface to substantially follow the shape of the exterior surface of the water tank, and a second surface, and a heat-dissipating element coupled to the base;

a controller configured to selectively generate a signal based on a temperature of water in the water tank;

a switch connectable to the power source, connected to the controller, and coupled to the second surface of the base, the switch configured to conduct power from the power source in response to the signal; and a heating element connected to the switch to receive the power.

36. The water heater of claim 35, wherein the heat-dissipating element is coupled to the second surface.

37. The water heater of claim 35, wherein the heat-dissipating element is integrally formed with the base.

38. The water heater of claim 35, wherein the mounting device includes a plurality of heat-dissipating elements.

39. The water heater of claim 35, wherein the thermally conductive mounting device further includes a mounting platform coupled to the base, and wherein the second surface includes the mounting platform.

40. The water heater of claim 35, wherein the second surface of the mounting device includes a flat portion to accept the direct mounting of the switch.

41. The water heater of claim 35, wherein the switch includes an electronic switch.

42. The water heater of claim 41, wherein the electronic switch includes a triac.

43. The water heater of claim 35, wherein the mounting device comprises a thermally conductive, electrically dielectric material.

44. The water heater of claim 35, wherein the mounting device is coupled to the water tank using a thermally conductive epoxy.

45. The water heater of claim 35, wherein the controller includes the switch.

46. The water heater of claim 35, wherein the controller is configured to selectively generate a second signal based on the temperature of the water, and wherein the water heater further comprises a second switch connectable to the power source, connected to the controller, and coupled to the second surface, the second switch configured to conduct power from the power source in response to the second signal, and wherein the water heater further comprises a second heating element connected to the second switch to receive the power.

47. The water heater of claim 46, wherein the second surface includes a channel between the first and second switches.

* * * * *